US008069585B2

(12) United States Patent
Rohwer-Kahlmann

(10) Patent No.: US 8,069,585 B2
(45) Date of Patent: Dec. 6, 2011

(54) SHOE, IN PARTICULAR SPORTS SHOE

(75) Inventor: Joerg Rohwer-Kahlmann, Munich (DE)

(73) Assignee: Puma SE, Herzogenaurach (DE)

( * ) Notice: Subject to any disclaimer, the term of this patent is extended or adjusted under 35 U.S.C. 154(b) by 687 days.

(21) Appl. No.: 11/914,673

(22) PCT Filed: Oct. 23, 2006

(86) PCT No.: PCT/EP2006/010189
§ 371 (c)(1),
(2), (4) Date: Nov. 26, 2007

(87) PCT Pub. No.: WO2007/051539
PCT Pub. Date: May 10, 2007

(65) Prior Publication Data

US 2008/0209765 A1 Sep. 4, 2008

(30) Foreign Application Priority Data

Nov. 5, 2005 (DE) ..... 20 2005 017 306 U

(51) Int. Cl.
*A43B 13/28* (2006.01)
*A43B 21/26* (2006.01)
*A43B 21/32* (2006.01)
*A43B 7/16* (2006.01)

(52) U.S. Cl. ..... 36/27; 36/35 R; 36/37; 36/92

(58) Field of Classification Search ..... 36/27, 35 R, 36/37, 92, 85, 86, 87
See application file for complete search history.

(56) References Cited

U.S. PATENT DOCUMENTS

| | | | | |
|---|---|---|---|---|
| 3,822,490 | A * | 7/1974 | Murawski | 36/105 |
| 5,138,776 | A * | 8/1992 | Levin | 36/38 |
| 6,457,261 | B1 * | 10/2002 | Crary | 36/27 |
| 6,487,796 | B1 | 12/2002 | Avar et al. | |
| 6,944,972 | B2 * | 9/2005 | Schmid | 36/27 |
| 7,395,616 | B2 * | 7/2008 | Fallon | 36/35 R |
| 7,496,982 | B2 * | 3/2009 | Clark et al. | 12/142 G |
| 7,814,683 | B2 * | 10/2010 | Lee | 36/28 |
| 2003/0000109 | A1 | 1/2003 | Kita | |
| 2005/0155254 | A1 | 7/2005 | Smith et al. | |

FOREIGN PATENT DOCUMENTS

| | | |
|---|---|---|
| CH | 497 146 | 10/1970 |
| DE | 4122086 | 1/1992 |
| DE | 10244433 | 4/2004 |
| EP | 0 873 061 | 10/1998 |

(Continued)

*Primary Examiner* — Jila Mohandesi
*Assistant Examiner* — Sharon M Prange
(74) *Attorney, Agent, or Firm* — Lucas & Mercanti, LLP

(57) ABSTRACT

The shoe, has a shoe upper part and a sole. The sole has a supporting part, which is designed for receiving the heel region of the wearer's foot and is connected to the shoe upper part, and a sole element, which is connected to the supporting part. In order to improve the damping behavior of the shoe, the supporting part and the sole element are spaced apart from each other, in the longitudinal direction of the shoe. The connection between the supporting part and the sole element is preformed at two spaced-apart points in such a way as to form, under the heel region of the wearer's foot, a gap. The gap extends at least in portions over the entire width of the sole. The sole element, in the rear end region of the shoe, is connected to the supporting part.

11 Claims, 6 Drawing Sheets

FOREIGN PATENT DOCUMENTS

Figure 1:
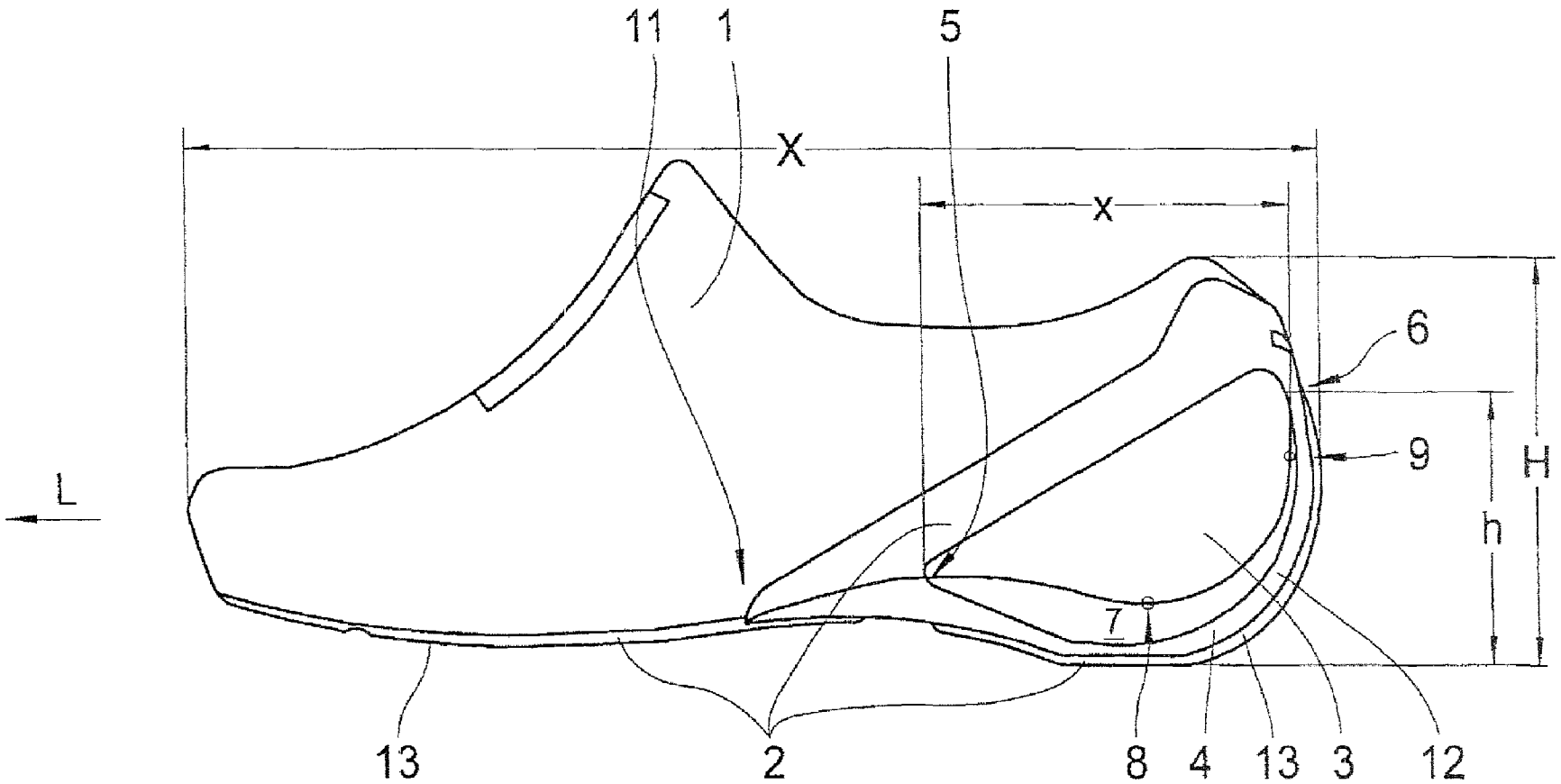

| | | |
|---|---|---|
| GB | 2243530 | 11/1991 |
| WO | 01/17384 | 3/2001 |
| WO | 02/41722 | 5/2002 |
| WO | 03/037123 | 5/2003 |

* cited by examiner

SHOE, IN PARTICULAR SPORTS SHOE

The invention relates to a shoe, in particular a sports shoe, with a shoe upper part and a sole, the sole having a support part or inner part, which is designed for receiving the heel region of the wearer' foot and is fixedly connected to the shoe upper part, and a sole element, which is connected to the support part or inner part.

In the case of shoes of this type, it is generally necessary to provide desired cushioning and damping characteristics of the sole. Various solutions for achieving this are known in the prior art.

WO 01/17384 A2 describes a sole for a shoe in the case of which a number of ribs which have a curved shape are positioned in the rear-foot region between a support part or inner part and an outsole. This achieves the effect that, when the sole is subjected to loading by foot impact forces, bending of the ribs takes place, the rib assuming an almost semi-ellipsoidal shape.

Furthermore, it is known to use relatively sophisticated damping elements, which are then capable of providing the shoe with defined cushioning and damping characteristics. An example of this that may be given is the solution according to WO 03/09243 A1, which discloses a damping element for a sports shoe of a special construction. The damping element has a large number of individual elements which are arranged next to one another and respectively form a cushioning and damping chamber in the manner of a piston-cylinder system. First and second elements that correspond in their form are connected to one another by means of a connecting portion, loading of the sole having the effect that the smaller element enters the larger one, which for this purpose forms a receiving space.

According to the solution mentioned, a damping element of this type is intended primarily for being integrated in a midsole, further examples of which are given in the prior art. Reference is made in this respect to EP 0 387 505 A1, which discloses a honeycomb damping element which is inserted into a receiving space in the midsole of the shoe.

A disadvantage of the previously known solutions is that the production of such high-quality shoes causes not inconsiderable cost to be incurred. It is therefore desirable to ensure sufficient cushioning and damping characteristics in the shoe without having to accept high production and/or assembly costs.

The invention is based on the object of developing a shoe, in particular a sports shoe, of the type mentioned at the beginning in such a way that it is possible to achieve a variation in the resilient rigidity or the damping behavior that can be controlled well, while, however, economic production of the shoe is to be ensured. Furthermore, a defined resilient rigidity is to be retained over the cushioning displacement; it is intended in particular to be possible that the cushioning behavior of the shoe sole can be influenced.

The solution that is provided by the invention to achieve this object is characterized in that the support part or inner part and the sole element of the shoe are spaced apart from each other, at least when viewed over part of their extent in the longitudinal direction of the shoe, the connection between the support part or inner part and the sole element taking place at two spaced-apart points in such a way as to form under the heel region of the wearer's foot a gap, in particular an air gap, between the support part or inner part and the sole element, the gap extending at least in portions over the entire width of the sole and the sole element in the rear end region of the shoe being connected to the support part or inner part.

The sole element in this case extends in the form of an arc or a shell around the support part or inner part in the rear end region of the shoe—when viewed from the side of the shoe—, the gap remaining, at least in portions, between the support part or inner part and the sole element. In this case, the sole element may be joined to the support part or inner part at a certain height above the ground. To this extent, in the case of this embodiment the sole element produces a closed form of the shoe or a termination in the rear region of the shoe.

With preference, the gap between the support part or inner part and the sole element, when viewed in the longitudinal direction of the shoe, is arranged between the lowest point of the heel or of the support part or inner part and the rear end of the support part or inner part, it being provided with particular preference that the gap extends at least over the region between the lowest point of the heel or of the support part or inner part and the rear end of the support part or inner part when viewed in the longitudinal direction of the shoe. In this respect, it may be provided in particular that the gap between the support part or inner part and the sole element when viewed in the longitudinal direction of the shoe extends over at least 10%, with preference over at least 15%, of the overall length of the shoe.

With this configuration, a "floating sole region" is created, i.e. a region provided with a spacing in the form of a gap—when viewed in the longitudinal direction of the shoe—that is free from material (filled only with air), in which the support part or inner part is spaced apart from the sole element, whereby a cushioning behavior of the sole is achieved.

When viewed from the side of the shoe, the gap between the support part or inner part and the sole element may be formed as an arc, in particular as an arc of a circle, or as a sickle. In this respect, the connecting point between the support part or inner part and the sole element that is arranged in the rear end region of the shoe may lie at a height above the surface of the ground that corresponds to at least 20%, usually at least 40% and with preference at least 60%, of the height of the shoe in the heel region.

The pronation and supination characteristics of the shoe can be selectively influenced if, according to a development, a supporting element is arranged in the gap between the support part or inner part and the sole element. This supporting element is in any event arranged such that the gap in question remains over a defined region—when viewed in the direction of the longitudinal axis of the shoe.

It is therefore provided with preference that the supporting element extends from the lowest point of the heel or of the support part or inner part in the longitudinal direction of the shoe toward the front end of the support part or inner part, and in particular leaves the rest of the gap free.

Furthermore, the supporting element may extend only over part of the width of the support part or inner part. The supporting element may in this case widen in the longitudinal direction of the shoe toward the front end of the support part or inner part. The pronation and supination characteristics can be selectively influenced by asymmetric widening of the supporting element toward the sides of the shoe.

The support part or inner part is formed with preference as a shell-shaped body or it has a shell-shaped body, which at least partially surrounds the heel of the wearer of the shoe.

The sole element is formed with preference at least partially by a joining part and an outsole, the joining part being connected by its one side to the outsole. In this respect, it may be provided in particular that the outsole extends over the entire region in which the support part or inner part and the sole element are spaced apart from each other.

The parts of the sole preferably consist of plastic, in particular of thermoplastic material. Especially preferred for this are polyethylene, polypropylene, polybutane, polyamide, polyurethane or a mixture of at least two of these plastics. The plastic may be translucent or transparent. The outsole may also consist of plastic, preferably of polyethylene, polypropylene, polybutane, polyamide, polyurethane or a mixture of at least two of these plastics, or of rubber, the material not being translucent or transparent.

The material of the individual component parts of the sole and their geometrical dimensions may be selected by a person skilled in the art to establish the cushioning and/or damping characteristics of the sole.

The proposed configuration achieves the effect in a simple way that a desired variation of the resilient rigidity of the shoe, and in particular of its sole, under loading is obtained—at least over a certain range of resilient displacement.

Production of the proposed shoe is possible in a simple way and at low cost, for which known methods are used.

Figure 2:
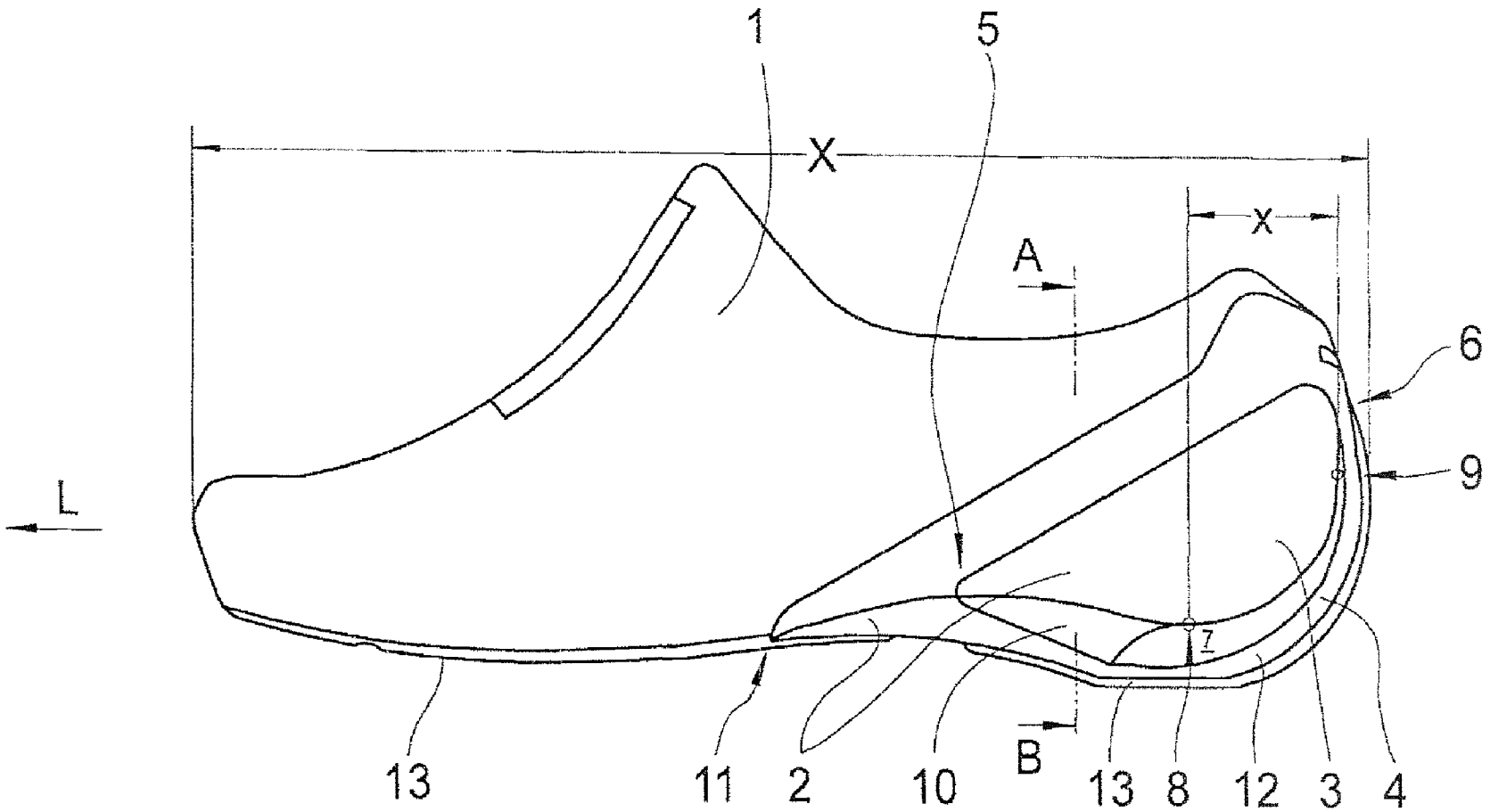
Figure 3:
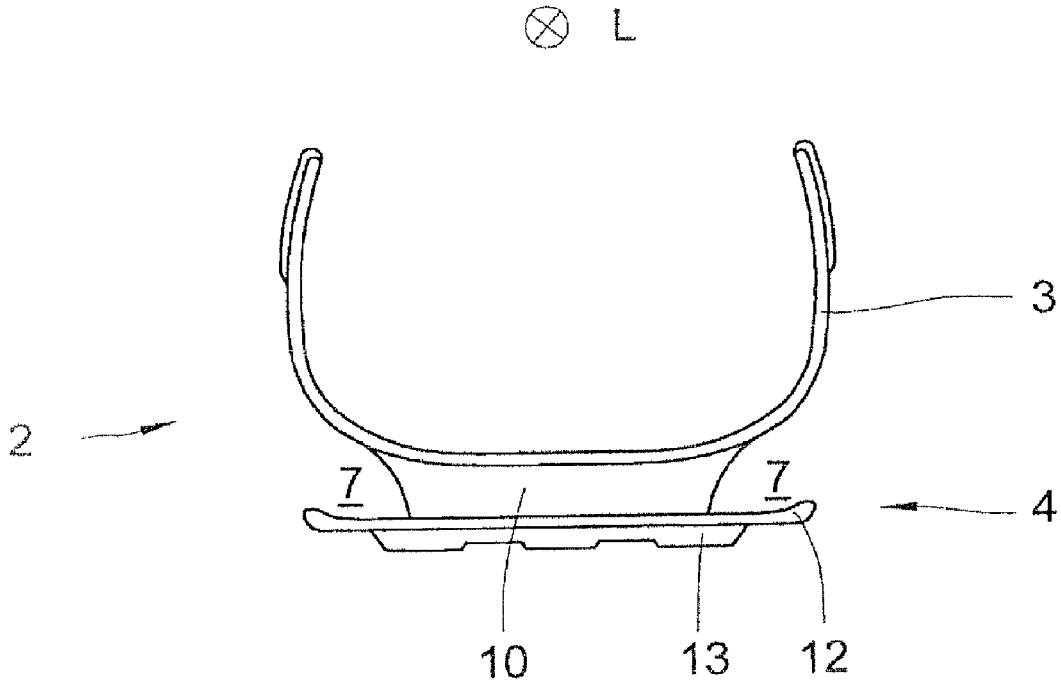
Figure 4:
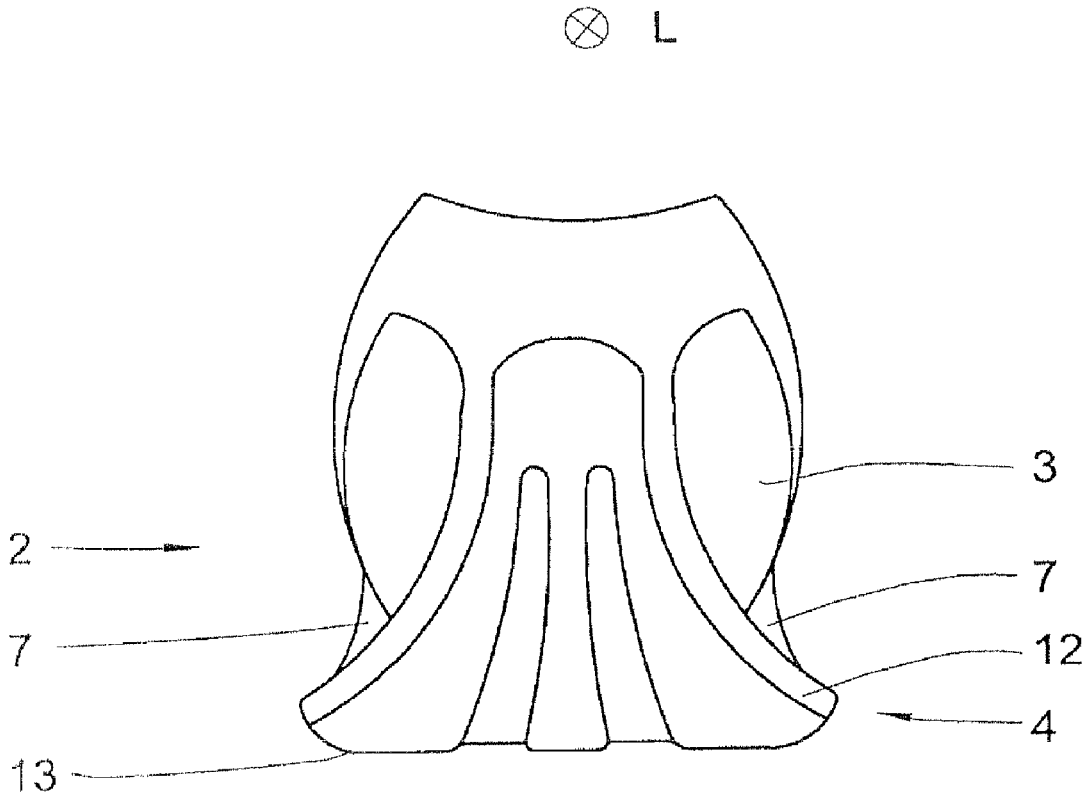
Figure 5:
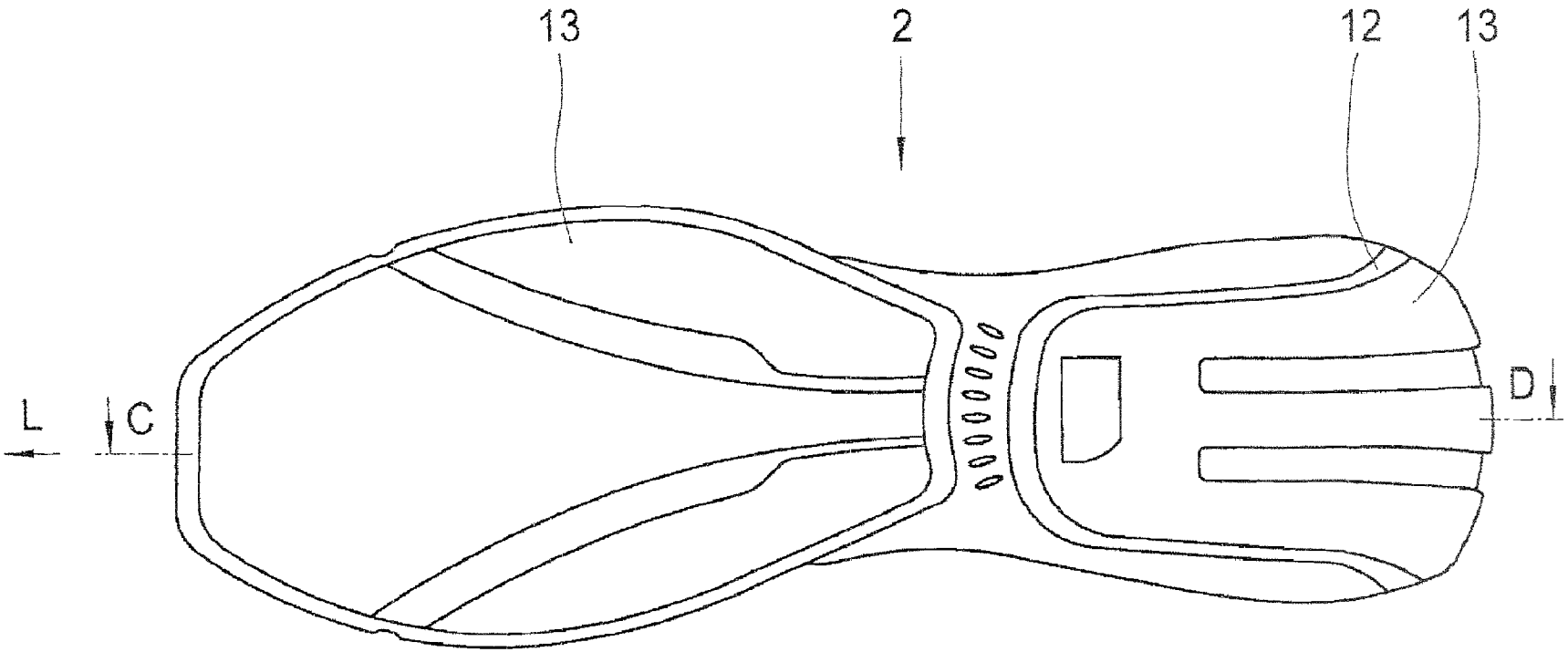
Figure 6:
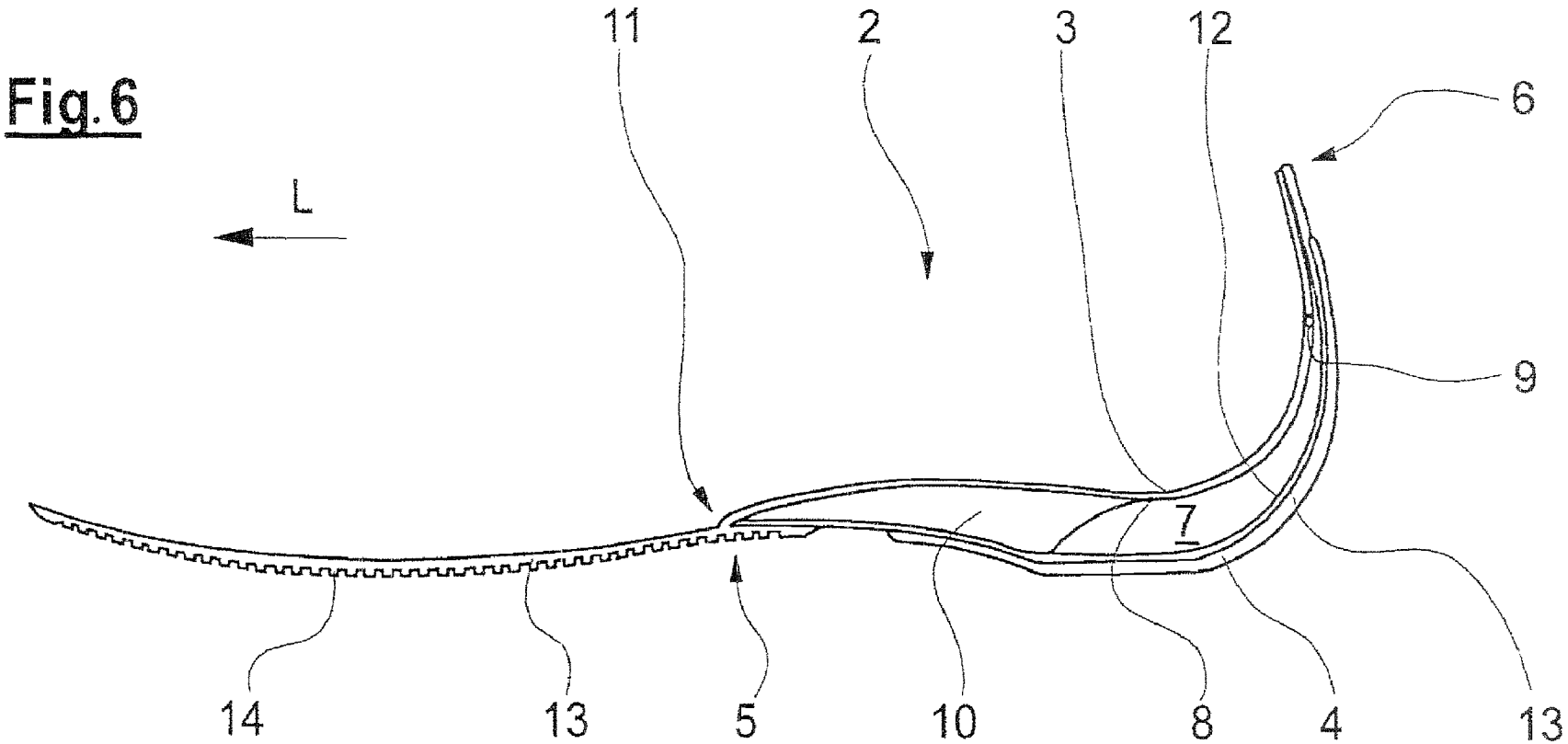

Exemplary embodiments of the invention are represented in the drawing, in which:

FIG. 1 shows a sports shoe, viewed from the side,

FIG. 2 shows an alternative embodiment of the shoe according to FIG. 1 with a supporting element formed as a heel wedge, FIG. 3 shows the section A-B according to FIG. 2 through the shoe with the shoe upper part not represented, FIG. 4 shows the view of the shoe from the rear with the shoe upper part not represented, FIG. 5 shows the view of the shoe from below and FIG. 6 shows the section C-D according to FIG. 5 for the shoe according to FIG. 2.

In FIG. 1, a sports shoe is represented as viewed from the side, having in a known way a shoe upper part 1, which is connected to a sole 2. The sole 2 has a support part or inner part 3, which is formed at least in the rear region of the shoe as a heel shell and is shaped so as it will partially surround the heel of the wearer's foot. Contact with the ground takes place by means of a sole element 4, which comprises at least in the rear region of the shoe a joining part 12, to the underside of which an outsole 13 is fastened, for example adhesively attached.

It is essential that a gap 7 that is free from material (filled only with air) and extends at least in portions over the entire width of the shoe or of the sole 2 remains between the support part or inner part 3 and the sole element 4. This gap 7 is created by the support part or inner part 3 being connected to the sole element 4 at two connecting points 5 and 6, so that a self-supporting region is obtained between these two points 5, 6; this region may be referred to as a "floating heel region".

As can be seen in FIG. 1, the gap 7, and consequently the self-supporting region, runs over an extent x, which is measured in the longitudinal direction L of the shoe. In relation to the overall length X of the shoe, it can be established that the extent x is at least 10% of this value, so that the self-supporting region proves to be very much larger than would be the case for a sole with honeycomb elements, the axis of which extends transversely in relation to the longitudinal direction L and horizontally. In the exemplary embodiment as shown in FIG. 1, the extent x is approximately 30% of the overall length X.

In order to achieve the desired cushioning effect of the self-supporting region, the gap 7 should extend—when viewed in the longitudinal direction L of the shoe—between the lowest point 8 and the rear end 9 of the support part or inner part 3. In the exemplary embodiment according to FIG. 1, the gap 7 is much longer however.

It can also be seen that the gap 7 has—when viewed from the side of the shoe—a shape in the form of a sickle or the form of an arc of a circle and ends in the rear region of the shoe, i.e. at the connecting point 6, at a height h that lies well above the region on the ground. In the exemplary embodiment, it is provided that the height h of the rear connecting point 6 corresponds to approximately 65% of the overall height H of the shoe in the heel region. With preference, the connecting point 6 is at least 40% of the height H.

Between the lowest point 8 and the rear end 9 of the support part or inner part 3, the gap 7 runs substantially in the form of an arc of a circle, the arc of the circle extending over at least 45°, preferably over at least 60°. In the exemplary embodiment according to FIG. 1, the extent of the arc of the circle is about 90°.

The exemplary embodiment of the sports shoe represented in FIG. 2 differs from that according to FIG. 1 in that a supporting element 10 is additionally provided, acting as a heel wedge and partially supporting the support part or inner part 3 with respect to the sole element 4. In the exemplary embodiment, the supporting element extends from the lowest point 8 of the support part or inner part 3 in the direction of the front end 11 of the support part or inner part 3.

As can be seen, the extent x of the gap 7 is reduced in comparison with the solution according to FIG. 1, but continues to be at least 10% of the overall length X of the shoe.

As can be seen from the sectional representation according to FIG. 3 (section A-B according to FIG. 2), the supporting element 10 does not extend over the entire width of the shoe, but only over part of the width; to the left and right of the supporting element 10—when viewed in the longitudinal direction L of the shoe—a laterally arranged gap 7 also remains along the longitudinal extent of the supporting element 10. The pronation and supination characteristics of the shoe can be influenced and adapted to desired conditions by appropriate shaping of the supporting element 10 and especially by the shape of its width over the longitudinal direction L of the shoe.

It can be seen from the representation according to FIG. 4 how the outsole 13 extends upward in the heel region of the shoe, attached to the outer side of the joining part 12. The outsole 13 is in this case provided with a desired profiling, as evident from FIG. 4.

An example of the profiling of the outsole 13 is also evident from the representation according to FIG. 5.

In FIG. 6, the section C-D according to FIG. 5 can be seen, revealing that the sole element 4 may have an outsole element 14 in the front region of the shoe.

LIST OF DESIGNATIONS

1 shoe upper part
2 sole
3 support part or inner part
4 sole element
5 connecting point
6 connecting point
7 gap
8 lowest point of the heel or of the support part or inner part
9 rear end of the support part or inner part
10 supporting element (heel wedge)
11 front end of the support part or inner part
12 joining part
13 outsole
14 outsole element
L longitudinal direction of the shoe
x extent of the gap in the longitudinal direction of the shoe
X overall length of the shoe
h height of the rear connecting point above the ground
H height of the shoe in the heel region

The invention claimed is:

1. A shoe, comprising:

a shoe upper part;

a sole, the sole having a support part in a heel region of the shoe, the support part for receiving the heel region of a wearer's foot, and the support part is fixedly connected to the shoe upper part; and a sole element, which is connected to the support part, wherein the support part and the sole element are spaced apart from each other, so as to form a gap between the support part and the sole element in the heel region of the shoe, the support part connected to the sole element at two spaced-apart points which delimit the gap, the gap extending at least in portions over an entire width of the sole and the sole element, in a rear end region of the shoe, being connected to the support part, the gap between the support part and the sole element is formed when viewed from a side of the shoe as an arc, a supporting element arranged in the gap between the support part and the sole element, the supporting element extends from a lowest point of the support part in the longitudinal direction of the shoe toward a front end of the support part, and leaves a rest of the gap free, the gap is free from any material between the support part and the sole element in a longitudinal direction of the gap except for the supporting element, the gap free of material extends a height of at least 40% of a height of the shoe measured at the rear end region of the shoe, the gap free of material extends a longitudinal length of at least 10% of an overall longitudinal length of the shoe measured from the rear end region of the shoe.

2. The shoe as claimed in claim 1, wherein the gap between the support part and the sole element is formed when viewed from the side of the shoe as an arc of a circle.

3. The shoe as claimed in claim 1, wherein the gap between the support part and the sole element, when viewed in the longitudinal direction of the shoe, extends between a lowest point the support part and a rear end of the support part.

4. The shoe as claimed in claim 1, wherein gap between the support part and the sole element, when viewed in the longitudinal direction of the shoe, extends at least over a region between a lowest point of the support part and a rear end of the support part.

5. The shoe as claimed in claim 1, wherein the gap extends over at least 15% of the overall longitudinal length of the shoe measured from the rear end region of the shoe.

6. The shoe as claimed in claim 1, wherein the gap at a height of at least 60% of the height of the shoe measured at the rear end region of the shoe.

7. The shoe as claimed in claim 1, wherein the supporting element extends only over part of a width of the support part.

8. The shoe as claimed in claim 1, wherein the supporting element widens in the longitudinal direction of the shoe toward a front end of the support part.

9. The shoe as claimed in claim 1, wherein the support part has a shell-shaped body, which at least partially surrounds the heel of the wearer of the shoe.

10. The shoe as claimed in claim 1, wherein the sole element is formed at least partially by a joining part and an outsole, the joining part being connected by its one side to the outsole.

11. The shoe as claimed in claim 10, wherein the outsole extends over an entire region in which the support part and the sole element are spaced apart from each other.

* * * * *